US008985202B2

(12) United States Patent
Vickers

(10) Patent No.: US 8,985,202 B2
(45) Date of Patent: Mar. 24, 2015

(54) SYSTEM FOR CONTAINMENT, MEASUREMENT, AND REUSE OF FLUIDS IN HYDRAULIC FRACTURING

(71) Applicant: P.V. Flood Control Corp., Calgary, Alberta (CA)

(72) Inventor: Paul Vickers, Carson City, NV (US)

(73) Assignee: P.V. Flood Control Corp., Calgary (CA)

( * ) Notice: Subject to any disclaimer, the term of this patent is extended or adjusted under 35 U.S.C. 154(b) by 0 days.

(21) Appl. No.: 13/904,995

(22) Filed: May 29, 2013

(65) Prior Publication Data

US 2013/0319660 A1 Dec. 5, 2013

Related U.S. Application Data

(60) Provisional application No. 61/652,727, filed on May 29, 2012.

(51) Int. Cl.
*E21B 43/26* (2006.01)
*E21B 21/06* (2006.01)
*E21B 21/01* (2006.01)

(52) U.S. Cl.
CPC ..... *E21B 21/063* (2013.01); *E21B 21/01* (2013.01)
USPC ..... 166/90.1; 166/308.1; 175/206

(58) Field of Classification Search
CPC ..... E21B 43/26; E21B 21/066; E21B 21/01; E21B 21/06; E21B 41/005; E21B 21/103; E21B 34/00
USPC ..... 166/90.1, 308.1–308.6; 175/206–215
See application file for complete search history.

(56) References Cited

U.S. PATENT DOCUMENTS

| | | | | |
|---|---|---|---|---|
| 4,133,761 | A * | 1/1979 | Posgate | 210/170.09 |
| 5,865,564 | A | 2/1999 | Miller et al. | |
| 6,062,313 | A * | 5/2000 | Moore | 166/357 |
| 6,364,571 | B1 | 4/2002 | Doolaege | |
| 7,278,486 | B2 | 10/2007 | Alba et al. | |
| 8,016,041 | B2 | 9/2011 | Kerfoot | |

(Continued)

FOREIGN PATENT DOCUMENTS

CA 2229525 A1 8/1999

OTHER PUBLICATIONS

PCT International Search Report and Written Opinion, PCT Application No. PCT/US2013/043170, Oct. 31, 2013, 12 pages.

(Continued)

*Primary Examiner* — Shane Bomar
*Assistant Examiner* — Kipp Wallace
(74) *Attorney, Agent, or Firm* — Fenwick & West LLP

(57) ABSTRACT

The system includes a number of flexible fluid containment structures, or tubes, for storing fluids used in or produced during fracking. The tubes may be filled to store water prior to introduction into the well or drilling waste expunged from the well. A series of valves and pumps control the flow of fluids to and from the tubes, well, and purification equipment. A back-flow preventer including a primary port, forward port, and return port supports bi-directional fluid transfer with the well. Drilling fluids are piped into the forward port and exit the primary port to the well. A flow meter may be coupled to the forward port to determine the volume of fluid flowing through the forward port to the well. Drilling waste may also return from the well via the primary port and exit the return port, which may also include a flow meter.

21 Claims, 5 Drawing Sheets

(56) References Cited

U.S. PATENT DOCUMENTS

| | | | | |
|---|---|---|---|---|
| 8,540,863 | B2 * | 9/2013 | Mothersbaugh et al. | 205/744 |
| 2004/0031623 | A1 * | 2/2004 | Fontana | 175/7 |
| 2005/0269134 | A1 * | 12/2005 | Strazhgorodskiy | 175/57 |
| 2007/0144739 | A1 * | 6/2007 | Fitzgerald | 166/250.14 |
| 2008/0210467 | A1 * | 9/2008 | Eia | 175/24 |
| 2010/0326663 | A1 * | 12/2010 | Bobier et al. | 166/307 |
| 2012/0012307 | A1 | 1/2012 | Nevin | |
| 2012/0181030 | A1 * | 7/2012 | Kajaria et al. | 166/308.1 |
| 2013/0105166 | A1 * | 5/2013 | Medvedev et al. | 166/308.1 |
| 2014/0008074 | A1 * | 1/2014 | Nevison | 166/308.6 |

OTHER PUBLICATIONS

"Tiger Dam System: Flood Protection Products: Tiger Dams," 1 page, undated, [Online] [Retrieved on Aug. 23, 2013] Retrieved from the Internet<URL:http://www.usfloodcontrol.com/products.html>.

Canadian Office Action, Canadian Application No. 2,874,982, Jan. 8, 2015, 4 pages.

* cited by examiner

SYSTEM FOR CONTAINMENT, MEASUREMENT, AND REUSE OF FLUIDS IN HYDRAULIC FRACTURING

CROSS REFERENCE TO RELATED APPLICATIONS

This application claims the benefit of U.S. Provisional Application 61/652,727, filed May 29, 2012, which is incorporated by reference herein in its entirety.

BACKGROUND

1. Field of the Disclosure

The present disclosure relates to hydraulic fracturing and more specifically to fluid containment and monitoring.

2. Description of the Related Art

Hydraulic fracturing (fracking) is a technique used to release petroleum, natural gas (including shale gas, tight gas, and coal seam gas), or other substances trapped within the Earth's crust for extraction. A typical fracking site commonly includes a four to six acre level surface of land, known as the well pad. In addition to supporting fracking well and drill infrastructure itself, the well pad houses additional equipment and infrastructure such as above ground containment ponds, piping, vehicle access points, and the numerous tanker trucks used for supporting drilling operations.

Tanker trucks are utilized to carry liquid drilling waste, expunged from the well, away from the drilling site. Additionally, tanker trucks are utilized to carry liquid drilling materials, such as water, to the drilling site. Excess fluids are stored in containment ponds prior to introduction into the well or being carried away from the drilling site by tanker truck. A containment pond is an earthen or manmade structure for storing large quantities of excess liquid drilling material that goes into the drilled well or liquid drilling waste expunged from the well. Typical fracking sites include numerous containment ponds for the various fluids used for drilling or expunged from the well. In order to construct the containment ponds, the well pad must be level. Given the common practice of drilling in remote locations, the exercise of leveling a four plus acre well pad requires thousands of hours of time and millions of dollars in transportation of equipment and labor costs.

A typical fracking site may require as many as four million gallons or more of stored water for drilling fluid, the majority of which may be stored in nearby bodies of water. Oftentimes, however, nearby water sources are not available or environmental regulations prohibit their use, potable water trucks transport the drilling fluid to the well pad, often keeping the water in a plethora of above ground containment ponds. To put the scale of reliance on water transportation in perspective, ten 2,000 gallon tanker trucks would each need to make 200 trips to supply four million gallons of water to the well pad. This too results in spending thousands of hours of time and millions of dollars in transportation and driver labor costs.

SUMMARY

Embodiments relate to a system and method of fluid containment and monitoring for use in hydraulic fracturing (fracking) The system includes a number of flexible fluid containment structures, or tubes, for storing fluids used in or produced during fracking. For example, the tubes may be filled to store water prior to introduction into the well or drilling waste expunged from the well. Each tube includes a fill port and empty port that are coupled to pumps for filling and emptying the tube. Each port may be coupled to a valve configured to enable filling or emptying of the fluid from the tube. In one embodiment, the valve is a check valve providing unidirectional flow. The port may include a locking mechanism that interfaces with the check valve to open the valve when a corresponding fitting of a fluid transport structure such as a pipe or hose is attached. Thus, a hose including the corresponding fitting may be attached to the port to empty fluid from the tube.

A backflow preventer including a flow meter provides accurate flow measurements of fluids going to/from a well or other structure. The backflow preventer includes a primary port, forward port, and return port. Drilling fluids are piped into the forward port and exit the primary port to the well. A flow meter may be coupled to the forward port to determine the volume of fluid flowing through the forward port to the well. Drilling waste may also return from the well via the primary port and exit the return port, which may also include a flow meter.

The backflow preventer may include a forward backflow prevention mechanism that activates to prevent drilling waste from exiting the forward port. Additionally, the backflow preventer may include a flow arresting mechanism to prevent the piping of drilling fluids through the return port. Additionally, the backflow preventer may include a return backflow prevention mechanism that activates to prevent drilling waste from flowing back through the return port. In such cases, a flow meter may also provide an accurate reading by measuring the forward and backward flow through the primary port.

An empty port of a first tube containing drilling fluid is coupled to the forward port of the backflow preventer. A first pump disposed between the empty port of the first tube and the forward port of the backflow preventer may push the drilling fluid from the first tube into the backflow preventer. The primary port of the backflow preventer is coupled to the well and/or another pump. A flow meter measures the amount of fluid passing through the forward port and/or return port of the backflow preventer, and transmits the monitored volumes to monitoring equipment. The backflow preventer may include a forward backflow prevention mechanism that substantially prevents reverse flow of fluid through the forward port. The forward backflow prevention mechanism may also provide the reverse flow of liquid drilling waste expunged from the well to a return port. A return backflow prevention mechanism may be activated while the forward backflow prevention mechanism is active to substantially prevent reverse flow of waste fluid through the return port. A flow arresting mechanism may be activated while drilling fluid is flowing into the forward port to prevent the piping of drilling fluids directly through the return port. Accordingly, while the forward backflow prevention mechanism is inactive, the flow arresting mechanism may be active.

The return port of the backflow preventer is coupled to a fill port of a second tube. A second pump disposed between the fill port and the backflow preventer may push the drilling waste expunged from the well into the second tube. The empty port of the second tube may be coupled to the fill port of a subsequent tube. A pump disposed between the pair of tubes may push fluid from one tube to the other. Any number of subsequent tubes for storing drilling waste may be added in a similar fashion. Similarly, additional drilling fluid storage tubes may be added in a similar fashion.

The empty port of a tube containing drilling waste, such as that of the third tube, is coupled to an input of purification equipment configured to extract reusable drilling fluids from the drilling waste. A pump disposed between the empty port of the third tube and the input of the purification equipment may push the drilling waste into the purification equipment. In turn, an exit port of the purification equipment is coupled to the fill port of a tube containing drilling fluid, such as that of the first tube. A flow meter monitors the volume of recycled fluid flowing from the purification equipment into the drilling fluid storage tubes and transmits the monitored volume to monitoring equipment. The monitoring equipment determines the difference between the drilling fluid usage through the backflow preventer and output from the purification equipment. In turn, the monitoring equipment may generate a signal for replenishing the drilling fluid based on the difference.

BRIEF DESCRIPTION OF THE DRAWINGS

The teachings of the embodiments can be readily understood by considering the following detailed description in conjunction with the accompanying drawings.

DETAILED DESCRIPTION OF EMBODIMENTS

Figure 1:
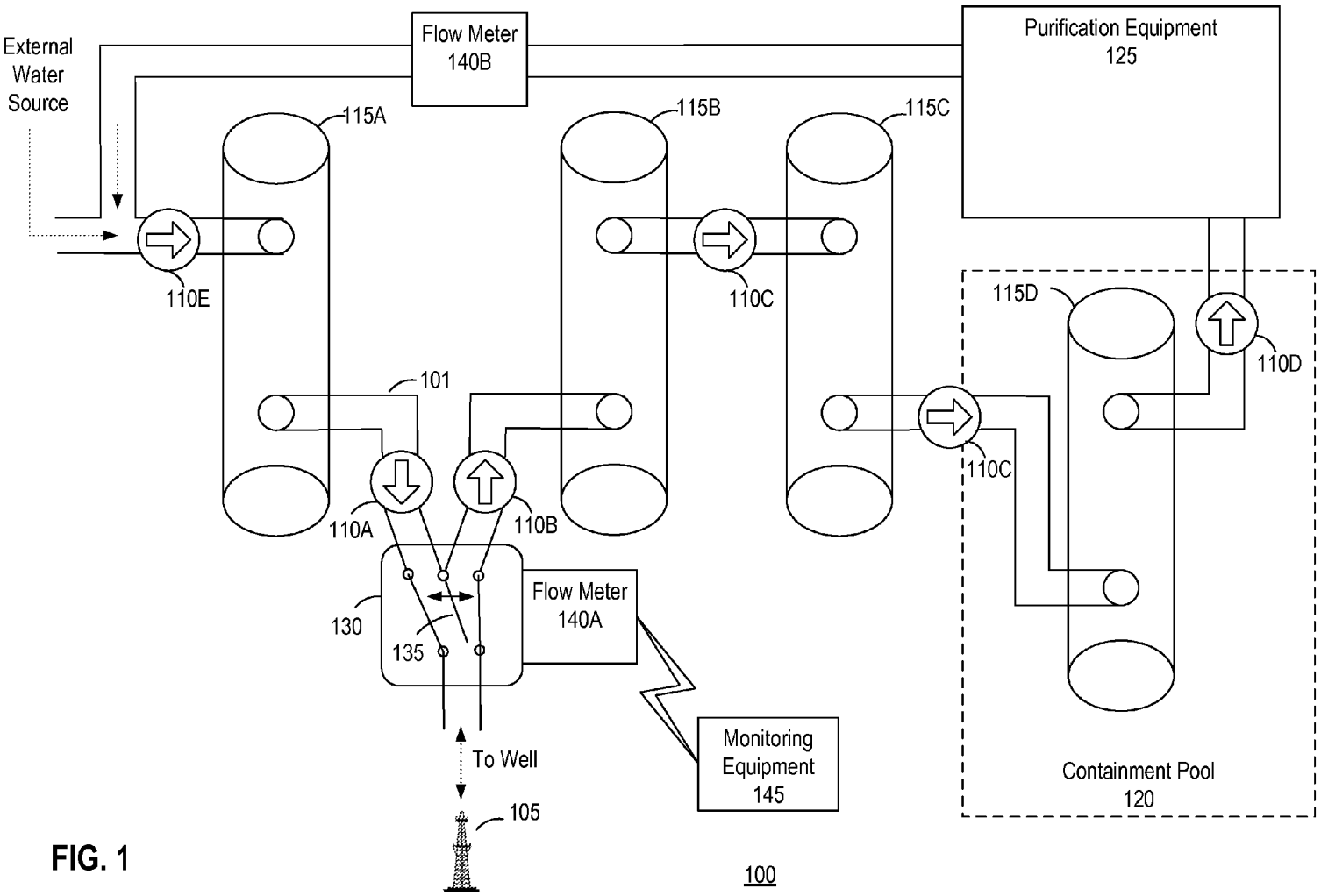
FIG. 1 is a diagram illustrating a fluid monitoring and containment system according to one embodiment.

The Figures (FIG.) and the following description relate to preferred embodiments by way of illustration only. It should be noted that from the following discussion, alternative embodiments of the structures and methods disclosed herein will be readily recognized as viable alternatives that may be employed without departing from the principles of the embodiments.

Reference will now be made in detail to several embodiments, examples of which are illustrated in the accompanying figures. It is noted that wherever practicable, similar or like reference numbers may be used in the figures and may indicate similar or like functionality. The figures depict embodiments for purposes of illustration only.

Overview

Hydraulic fracturing (fracking) sites are often laid out on large, e.g., four to six acre, surfaces of land known as the well pad. In fracking, drilling fluids are used to extract substances such as natural gas and petroleum trapped within the Earth's surface. Drilling waste fluids too, are often expunged from the well, and oftentimes includes amounts of the extract substances and other contaminates including soil, dissolved minerals or other elements suspended in the fluid, etc. that may not simply be introduced back into the environment. Accordingly, fracking operations heavily rely on the storage and transportation of drilling fluids and waste fluids to and from the well and/or drilling site via tanker trucks.

Historically, large earthen or other man-made containment ponds were constructed on a large, level well pad to receive and transfer fluids to the tanker trucks. The majority of leveled acreage for the well pad supports fluid storage, which requires a significant amount of man and machine hours. Example containment pond structures created on the well pad include dug-out sections of the well pad and/or above ground ponds constructed on the level surface. A fracking site utilizing a system including fluid containment structures, or tubes, may reduce the amount of level acreage required. The tubes may be positioned on inclines or over other obstacles that traditional ponds cannot. Thus, by utilizing tubes, leveling and other site preparation operations may be limited to supporting other site equipment such as the well and decrease startup time.

Dug-out pond sections are covered in concrete, plastic, or other fluid-tight substance to prevent loss of fluids into the ground. In the case of drilling waste, these coverings are of utmost importance to prevent spillage into the environment. However, the coverings do fail, which may require constant testing and monitoring by site personnel. Above ground ponds constructed on the level surface face similar disadvantages. Tubes, in contrast, may provide additional assurance in preventing spills. As any tube leaks or failures are restricted to a single tube through the use of pumps and valves restricting unwanted forwards and backwards flow, environmental safety is improved. Housing tubes in a shallow containment pond including a plastic or other ground covering may provide additional environmental safety assurance. The shallow containment pond, in turn, needs only (at minimum) to hold the volume of fluid of a single tube in the result of a tube's failure. Due to the redundancy, many tubes may be housed in a single shallow containment pond while still minimizing the time required to set up a drill site.

Furthermore, both types of traditional ponds are open to the environment, which poses a variety of concerns including environmental and logistical. Environmental concerns may include the interactions of wildlife, ultra-violet rays, and substances in the air with the contents in the ponds and the release of chemicals into the air from the containment ponds. Logistical concerns include the evaporations of pond contents in general and/or the differing rates of evaporations of the different components of a mixture. Tubes, in contrast, provide airtight containment of drilling fluids and waste fluids from the environment and elements.

Additional advantages to using tubes over traditional containment structures include the ability to accurately monitor the amount of fluids available and used in fracking. Specifically, because the drilling fluid volumes within the tubes are not changing like those of exposed containment pods, flow measurements out of (e.g., to the well) and into (e.g., from on-site purification equipment) the tubes provide an accurate view of the amount of drilling fluids available and remaining storage capacity. Further, due to the compartmental nature of the tubes, tubes may be added or removed as desired without potential environmental consequences. Accordingly, the use of tanker trucks may be minimized only to those instances where additional drilling fluids are needed and to remove excess drilling waste from the site after the purification process.

Example Containment and Monitoring System

FIG. 1 is a diagram illustrating a fluid monitoring and containment system 100 according to one embodiment. As shown, the fluid monitoring and containment system includes a number of tubes 115 coupled to equipment used in fracking.

In one embodiment, the tubes 115 are airtight flexible fluid containment structures placed on a well pad to store water or other drilling fluids until they are needed for use, without tying up expensive trucks or requiring an extensive construction outlay of leveling portions of the well pad to support above ground containment ponds. An example tube 115, when filled, may be approximately 100' long, with a diameter exceeding 36' and hold in excess of 750,000 gallons. Prior to filling, the tube may be rolled up along its length for compact storage and transportation.

Due to their flexible nature, the length of each containment tube 115 may be positioned when empty to take on be nearly any shape, e.g., a square, a "7", an arc, etc., which permits use of the tubes in many areas where conventional containment ponds are impractical. For example, in areas where trees, other obstacles or land boundaries need to be accounted for, the tubes 115 may be easily positioned around the trees or other obstacles and then filled. Additionally, unlike other containment pond 120 based systems, tubes 115 may be placed on uneven terrain while zigzagging between or around trees and other hazards that would traditionally need to be leveled and removed from the well pad.

Additionally, unlike open-air ponds, embodiments of the tubes' 115 with airtight design prevents harmful chemicals from entering the atmosphere or harming wildlife. In other embodiments, tubes 115 as used herein may refer to any bladder or similar storage container capable of holding fluids used in the fracking process.

Once placed around obstacles, the tubes 115 may be filled and coupled to each other and other equipment via a series of fluid piping structures 101 such as hoses or pipes. Additional tubes 115 may be linked into the system 100 as desired to provide on-demand fluid containment. Pumps 110 dispersed throughout the system 100 facilitate the flow of fluid through the piping structures 101 between tubes 115 and other equipment. The pumps 110 help push fluids against gravity and to fill flexible tubes 115. The pumps 110 may impede the forward and/or reverse flow of fluid when not active or as desired, similar to the tubes, to minimize potential spillage in case of failure. An additional advantage of this configuration, for example, is that the opposite end of a pump 110 coupled to a given tube 115 or other equipment 125, 130, etc., may be decoupled without significant spillage from the tube or other equipment. The tubes 115 may include integrated (or attached) valves (not shown) that couple to piping supplying the flow of fluids.

In one embodiment, the tubes 115 described here utilize airtight check valves (not shown) that enable a tube 115 to be pressurized and filled to its maximum capacity. The check valve also enables filling of tubes 115 from the base of an incline in order to force fluids uphill in situations with unlevel terrain. Additionally, check valves minimize the leakage of fluids through the use of connecting piping (or hose) with a locking system. The locking system may interface with a check valve integrated in the exit port of a tube 115 in order to extract fluid when the piping is attached and subsequently interface with the check valve to prevent the flow of fluid when removed. The locking system may alternatively interface with a check valve integrated in the fill port of a tube 115 in order to add fluid when the pressure in the piping is greater than that of the tube, but not in the reverse, thus preventing backward flow.

Drilling fluid tubes 115A store water and other fluids pumped into the ground to displace trapped natural gas and petroleum. Initially, the drilling fluid tube 115A may receive drilling fluids pumped in 110E from an external source such as a tanker truck. The drilling fluid tube 115A is also coupled to the well 105 in order to supply (e.g., via pump 110A) the well with the drilling fluid.

While only one drilling fluid tube 115A is shown, a fracking site 100 may include any number of drilling fluid tubes 115 linked together (e.g., as shown for tubes 115B-D). For example, a typical fracking site 100 requiring 4 million gallons of water may require six such tubes 115A to support drilling operations. Thus, for example, the first tube in the set of drilling fluid tubes receives drilling fluid pumped in 110E from the external source and/or purification equipment 125 that is then pumped to the other linked tubes, and a last tube in the set of drilling fluid tubes is coupled to the well 105.

Similar to the drilling fluids tubes 115A used to store fluids such as water, additional tubes 115B-D may be used to hold drilling waste created as a result of the fracking process. In one embodiment, drilling waste tubes 115B-D are constructed of special chemical resistant material, for example resistance to various chemical byproducts of fracking such as hydrocarbons, chlorine, etc. These materials may be different from the material used to contain non-hazardous stored water or other drilling fluids in the drilling fluid tubes 115A. In another embodiment, all tubes 115 are constructed from the same material.

Drilling waste tubes 115B-115D store liquid waste expunged from the well 105. Multiple drilling waste tubes (e.g., 3) may be coupled together as needed to store the waste. For example, a first drilling waste tube 115B may receive drilling waste contents pumped 110B from the well 105. In turn, drilling waste tube 115B may be coupled to a pump 110C to pass the received drilling waste to a subsequent tube 115C. Drilling waste tube 115C may, in turn, be coupled to a pump 110C and so forth to store and channel additional volumes of drilling waste. The last drilling waste tube 115D in the chain may be coupled to purification equipment 125 for recycling drilling fluid. A pump 110D may supply the purification equipment 125 with the drilling waste received at the drilling waste tube 115D.

The purification equipment 125 recycles drilling waste received from the drilling waste tubes 115B-D to replenish drilling fluid stored in the drilling fluid tubes 115A. The purification equipment 125 may operate using conventional mechanisms such as evaporation, filtering, etc. The number of drilling fluids tubes 115A and amount of externally transported fluids required to support drilling operations may be reduced through the use of the purification equipment 125. The purification equipment 125 may be coupled to additional tubes (not shown) to hold the drilling waste remaining after purification.

In some embodiments, one or more tubes 115D may be housed in an additional containment structure, such as containment pool 120. As described above, because the containment pool 120 provides a redundant level of containment, it need only be sized based on the failure of a single tube. Smaller redundant containment structures 120 may, alternatively, provide protection against any punctures in the tubes 115, or pump 110 and fitting leaks where the various components 110, 115, etc., of the system 100 are coupled.

In an embodiment, the containment pool 120 is constructed of additional tubes (not shown) to form a perimeter around the drilling waste tube 115D. For example, a 30' length by 110' width by 19" high containment pool 120 may surround a 20'×100' drilling waste tube 115. Smaller, easier to maneuver lengths of tubes, may be interlocked and/or overlapped to form the containment pool 120. The interior area of the containment pool 120 may include a ground covering, or liner, attached to the perimeter tubes to prevent any fluids in the pool from escaping. In one embodiment, the liner is a tarp or plastic sheeting, slightly larger than the containment pool 120 area.

Additional advantages of the system 100 illustrated in FIG. 1 include fluid flow control and monitoring. A feature of one embodiment is the coupling of drilling fluid tubes 115A and drilling waste containment tubes 115B to the well 105 via a single hose or pipe attached to or inserted into the well. To accomplish this, a backflow preventer 130 provides a Y connection where the drilling fluids tube 115A and drilling waste tube 115B are coupled to the stems of the Y and the base to the well 105. The backflow preventer 130 includes a flow control mechanism 135 configured to alternately enable flow from the drilling fluid tube 115A to the well 105 or from the well 105 to the drilling waste tube 1115B, and not from the drilling fluid tube 115A to the drilling waste tube 115B. This configuration ensures that pump 110A provides drilling fluid to the well 105 but not to the drilling waste tubes 115B and that return fluids from the well 105 are not transferred back into the drilling fluid tubes 115A.

A feature of another embodiment is the accurate measurement of fluids pumped in and out of the well. In one embodiment, the backflow preventer 130 includes a flow meter 140. The flow meter 140A determines the volume of fluid pumped into 110A the well 105 from the drilling fluid tube 115A and pumped out of 110B the well into the drilling waste tube 115B. In another embodiment, the flow meter(s) 140A for determining flow into and out of the well 105 are separate from, but coupled to the respective branches of the backflow preventer going to the tubes 115A, 115B.

Additional embodiments may include a flow meter 140B monitoring flow from purification equipment 125 into the drilling fluid tubes 115A. Flow meters 140 may be designed such that workers who wish to alter readings in their favor cannot easily tamper with them. For example, the flow meters 140 may contain wireless communication mechanisms (Bluetooth, Zigbee, WiFi, Cellular/GSM, etc.) for automated transmission of flow data to centralized monitoring equipment 145, such as a computer server system or mobile computer at the drilling site.

The monitoring equipment 145 may include a processor, non-transitory computer readable medium and associated hardware components configured to perform calculations on collected flow meter 140 data. For example, the monitoring equipment 145 may compare the volumes of drilling fluid use to replenishment to automatically schedule tanker trucks for drilling fluid replenishment or determine when additional drilling fluid tubes are needed for storage. In another example, the monitoring equipment 145 may compare the volumes of drilling waste stored in the drilling waste tubes 115B-D to that processed by the purification equipment 125 to schedule tanker trucks for drilling waste removal or determine when additional drilling waste tubes are needed for waste storage. In turn, remaining storage capacity of collections of tubes (e.g., linked tubes for drilling fluid storage or drilling waste storage) may be based on a rated capacity and volume flow in/out of the collection of tubes as recorded by the flow meters 140.

Example Backflow Preventer Configuration

Figure 2B:
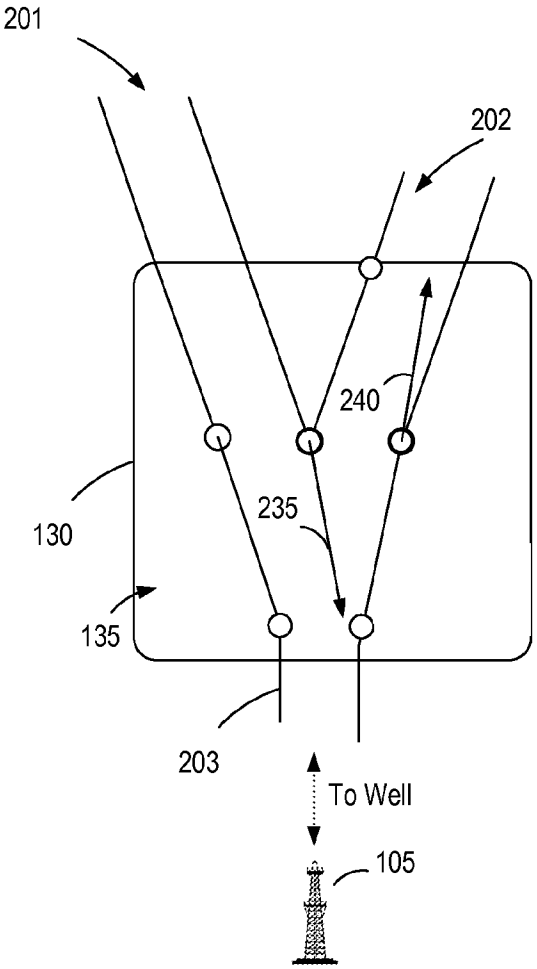
FIG. 2B is a diagram illustrating an example of a backflow preventer for controlling the flow of fluid, according to another embodiment.
Figure 2A:
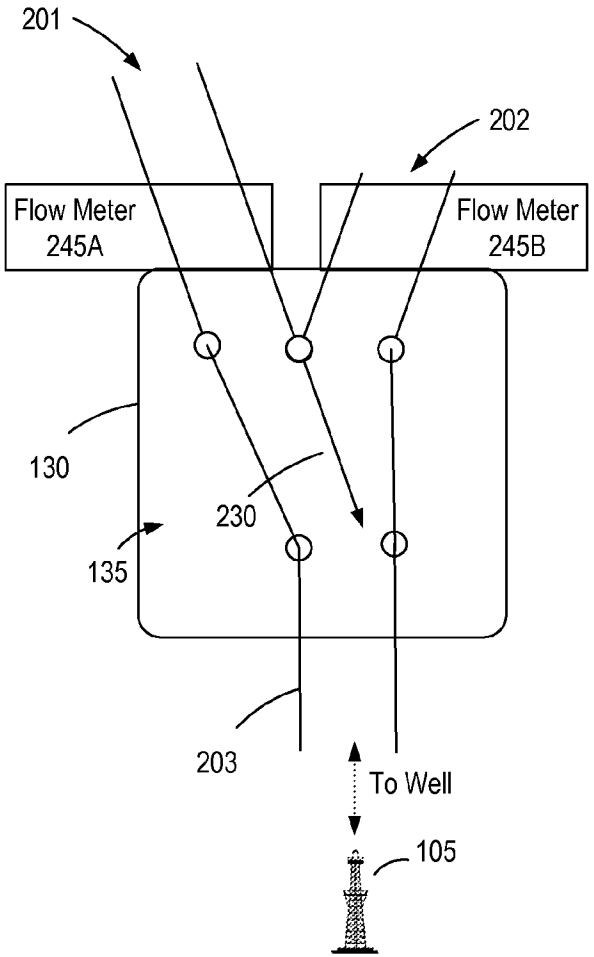
FIG. 2A is a diagram illustrating an example of a backflow preventer for controlling the flow of fluid, according to one embodiment.

FIG. 2A is a diagram illustrating an example of a backflow preventer 130 for controlling the flow of fluid, according to one embodiment. As shown, the backflow preventer 130 include three ports. A forward port 201 receives fluid, for example from a drilling fluid tube 115A, which is passed through to the primary port 203 to the well 105. The primary port 203 may also receive drilling waste from the well 105, which is passed through the return port 202, for example to a drilling waste tube 115B.

The backflow preventer 130 further includes a flow control mechanism 135 that controls flow of drilling fluid and drilling waste through the three ports. The flow control mechanism 135 may be manually activated, e.g., by a mechanical control, or automatically activated, e.g., due to the pressure of fluid received at the different ports.

The flow control mechanism 135 may provide a forward backflow prevention mechanism that substantially prevents reverse flow of fluid through the forward port 201 from the return port 202 or primary port 203 and a flow arresting mechanism that prevents the flow of drilling fluids directly from the forward port 201 through the return port 202.

In one embodiment, the flow control mechanism 135 includes a single valve 230 configuration that, when actuated, establishes flow between the forward port 201 to the primary port 203 such that drilling fluids may be pumped to the well 105. The single valve 230 may simultaneously arrest flow through the return port 202 when actuated to provide a flow arresting mechanism. In turn, when the valve 230 is not actuated, it provides a forward backflow prevention mechanism that substantially prevents reverse flow of fluid through the forward port 201 and establishes flow between the primary port 203 and the return port 202 such that waste fluids may be pumped away from the well 105.

In an automatically operated configuration, the valve 230 may actuate when the pressure in the forward port 201 is greater than the return port 202 and primary port 203. When the pressure in the forward port 201 is less than that of the return port 202 or the primary port 203, the valve 230 closes to prevent flow of drilling waste into the forward port. Thus, the backflow preventer 130 provides a single hose or pipe coupling via the primary port 203 to the well.

Also shown are flow meters 245A, 245B coupled to the primary port 201 and return port 202 of the backflow preventer 130 to provide readings corresponding to the volume of fluid passing through the respective ports.

FIG. 2B is a diagram illustrating an example of a backflow preventer 130 for controlling the flow of fluid, according to another embodiment. As shown, the backflow preventer 130 include three ports. A forward port 201 receives fluid, for example from a drilling fluid tube 115A, which is passed through to the primary port 203 to the well 105. The primary port 203 may also receive drilling waste from the well 105, which is passed through the return port 202, for example to a drilling waste tube 115B.

The backflow preventer 130 further includes a flow control mechanism 135 that controls flow of drilling fluid and drilling waste through the three ports. The flow control mechanism 135 may be manually activated, e.g., by a mechanical control, or automatically activated, e.g., due to the pressure of fluid received at the different ports.

The flow control mechanism 135 may provide a forward backflow prevention mechanism that substantially prevents reverse flow of fluid through the forward port 201 from the return port 202 or primary port 203, a flow arresting mechanism that prevents the flow of drilling fluids directly from the forward port 201 through the return port 202, and a return backflow prevention mechanism that substantially prevents reverse flow of fluid through the return port 202.

In one embodiment, one or more of these mechanisms may be separate and activated such that while the forward backflow prevention mechanism is active, the reverse backflow prevention mechanism may free activate to provide unidirectional flow of drilling waste through the return port 202, and thus enable a drilling waste flow meter (not shown) to provide more accurate readings.

In one embodiment, the flow control mechanism 135 includes a dual valve 235, 240 configuration. The first valve 235, when actuated, establishes flow from the forward port 201 to the primary port 203 such that drilling fluids may be pumped to the well 105. When not actuated, the first valve 235 provides a forward backflow prevention mechanism that substantially prevents reverse flow of fluid through the forward port 201 from the return port 202 or primary port 203. Additionally, when actuated, the first valve 235 provides a flow arresting mechanism to prevent the piping of drilling fluids through the return port 202.

The second valve 240, when actuated, establishes flow from the primary port 203 to the return port 202 to receive drilling waste when the first valve 235 is not actuated. When not actuated, the second valve 240 provides a return backflow prevention mechanism that prevents drilling waste from flowing back through the return port 202.

In an automatically operated configuration, the first valve 235 may actuate when the pressure in the forward port 201 is greater than the primary port 203, e.g., due to flow of drilling fluid from the drilling fluid tube 115A. The second valve 240, in turn, may actuate when the pressure in the primary port 203 is greater than in the return port 202, e.g., due to flow of drilling waste from the well 105. Thus, the backflow preventer 130 provides a single hose or pipe coupling via the primary port 203 to the well.

Figure 3A:
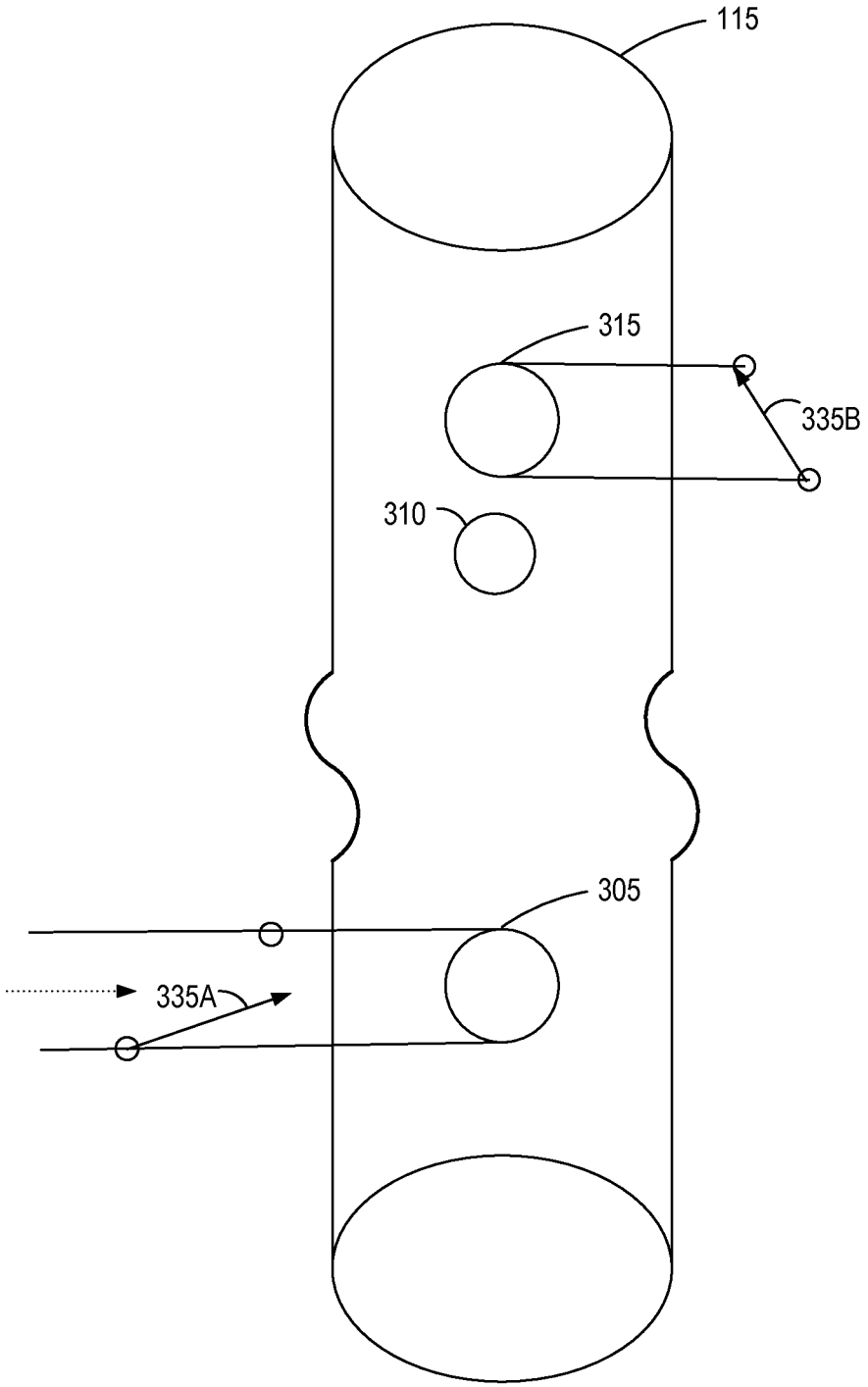
FIG. 3A is a diagram illustrating an example tube configuration for filling the tube, according to one embodiment.

FIG. 3A is a diagram illustrating an example tube configuration for filling the tube, according to one embodiment. As shown, the tube 115 includes a fill port 305, empty port 315 and air release valve 310. The air release valve 310 may be actuated to safely release trapped gases in the tube 115.

In one embodiment, the fill port 305 and/or empty port 315 include grommets that interlock into a valve 335 opening that permits pumping into the tube 115. The valves 335 automatically close when the tube 115 pressure exceeds that of the fluid or gas entering the respective port. In some embodiments, a tube 115 may have multiple valves 335 at each end. For example, each end may have three valves: one for air release 320, and two for fluid hose or pipe connections. The fill port 305 and empty port 315 may have an identical and/or different configuration.

As shown, the fill port 305 includes a valve 335A such as a check valve to provide unidirectional flow into the tube 115. Thus, the check valve enables filling of the tube 115 from the base of an incline in order to force fluids uphill in situations with unlevel terrain. The empty port 315 may similarly include a unidirectional check valve for receiving and containing fluid within the tube 115. This configuration enables the empty port 315 of the tube 115 to be uncoupled from other equipment without releasing the tube's contents. To empty the tube 115, the locking mechanism of the ports 315 may be configured to open the valve 335 when a pipe or hose with a corresponding fitting to unlock the value is inserted to release the tube contents.

The check valve 335 enables drill site personnel to safely couple and decouple a tube 115 from pumps and other equipment without needing to detach the fill hose. Similarly, the locking mechanism engaging the valve 335 enables drill site personnel to safely couple and decouple pumps and other equipment from the empty port 315. Additional check values may be integrated before and after pumps or other equipment to minimize spills.

Figure 3B:
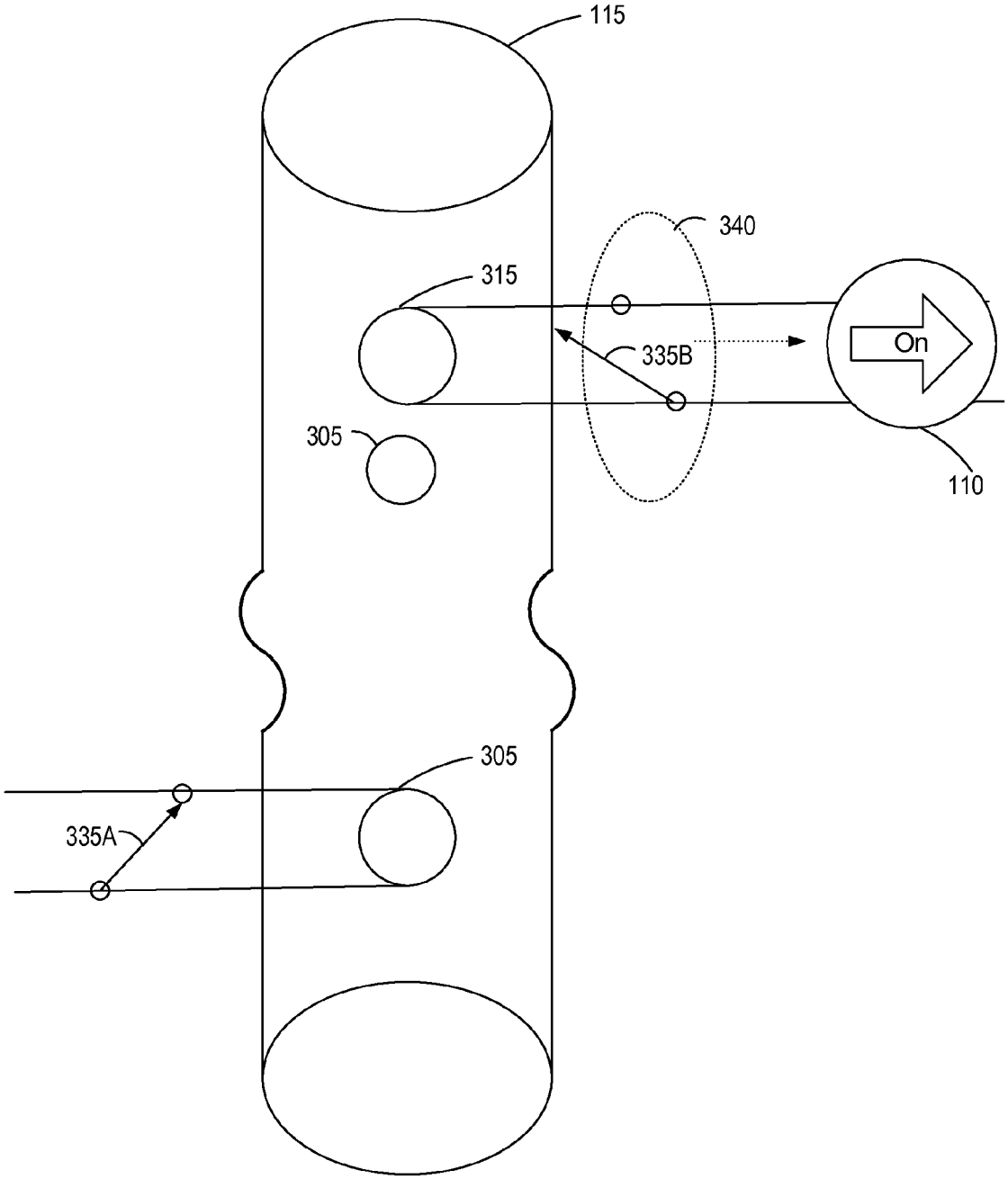
FIG. 3B is a diagram illustrating an example tube configuration for emptying the tube, according to one embodiment.

FIG. 3B is a diagram illustrating an example tube configuration for emptying the tube, according to one embodiment. As shown, the tube 115 includes a fill port 305, empty port 315 and air release valve 310. The check valve 335A of the fill port 305 is closed to prevent the release of tube 115 contents.

The empty port 315 of the tube 115 is coupled to a pump 110 via a hose or pipe with a corresponding fitting that engages the locking mechanism 340 to open the empty port valve 335B. In turn, fluid from the tube 115 freely flows through the empty port 315 to the pump 110. The pump 110 may provide tube 115 contents to the well 105, another tube, or other equipment. Detachment of the hose or pipe from the locking mechanism 340 cause the empty port valve 335B to close, thus preventing spillage of tube contents.

Figure 4:
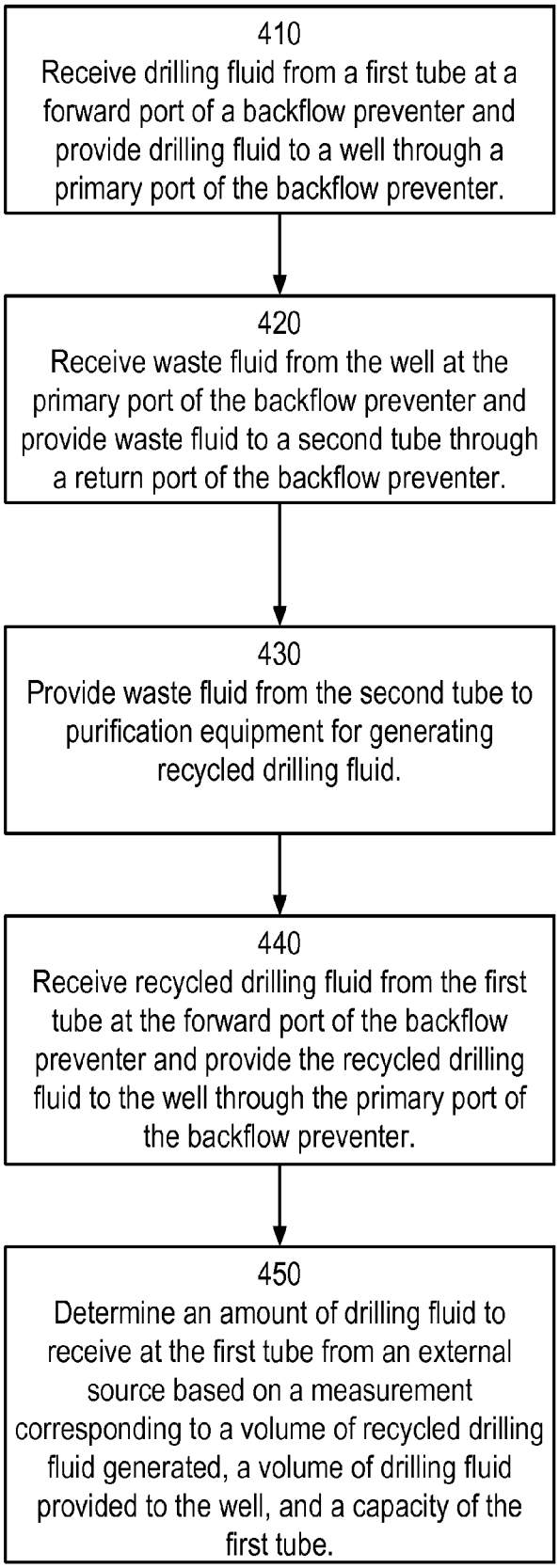
FIG. 4 is a flowchart illustrating a method of fluid monitoring and containment, according to one embodiment.

FIG. 4 is a flowchart illustrating a method of fluid monitoring and containment, according to one embodiment. An initial amount of drilling fluid such as water is stored in a first tube for use in a fracking process.

A backflow preventer coupled to the first tube receives 410 drilling fluid from the first tube at a forward port. The backflow preventer provides the received 410 drilling fluid to a well through a primary port of the backflow preventer. The backflow preventer may include a flow arresting mechanism to prevent the flow of waste fluid through a return port for waste fluids.

In turn, the backflow preventer receives 420 waste fluid from the well at the primary port. The backflow preventer may include a forward backflow prevention mechanism to prevent the flow of waste fluid through the forward port. A return port of the backflow preventer, which is coupled to a second tube, provides the received 420 waste fluid to the second tube.

The second tube, in turn, provides 430 the waste fluid to purification equipment for generating recycled drilling fluid. Recycled drilling fluid is subsequently received 440 from the first tube at the forward port of the backflow preventer. The backflow preventer, in turn, provides the recycled drilling fluid to the well through the primary port of the backflow preventer.

Embodiments of the backflow preventer and purification equipment may include flow meters for determining the volume of fluid flowing to/from the well and recycled fluid generated. In turn, the method may further include determining 450 an amount of drilling fluid to receive at the first tube from an external source based on one or more measurements corresponding to a volume of recycled drilling fluid generated, a volume of drilling fluid provided to the well, and a capacity of the first tube.

Additionally, embodiments of the backflow preventer may include a return backflow prevention mechanism to prevent the reverse flow of waste fluid through the backward port back to the well.

Upon reading this disclosure, those of ordinary skill in the art will appreciate still additional alternative structural and functional designs through the disclosed principles of the embodiments. Thus, while particular embodiments and applications have been illustrated and described, it is to be understood that the embodiments are not limited to the precise construction and components disclosed herein and that various modifications, changes and variations which will be apparent to those skilled in the art may be made in the arrangement, operation and details of the method and apparatus disclosed herein without departing from the spirit and scope as defined in the appended claims.

What is claimed is:

1. A system of fluid containment for use in hydraulic fracturing (fracking), the system comprising:

a plurality of fluid containment structures configured to store fluid, each fluid containment structure comprising a flexible body;

a first fluid transportation structure coupled to the first fluid containment structure;

a second fluid transportation structure coupled to the second fluid containment structure;

a backflow preventer comprising:

a forward port coupled to the first fluid transportation structure and configured to receive drilling fluid from the first fluid containment structure, a primary port coupled to a well, the primary port configured to provide the drilling fluid to the well and receiving waste fluid from the well, a return port coupled to the second fluid transportation structure and configured to provide the received waste fluid from the well to the second fluid transportation structure, and a flow control mechanism to substantially prevent the flow of waste fluid through the forward port and substantially prevent the flow of drilling fluid through the return port and the return port alternately couples with the primary port to provide the drilling fluid to the well and receive the waste fluid from the well; and a monitoring system comprising:

a first flow meter coupled to the forward port of the backflow preventer configured to transmit a first signal corresponding to a volume of drilling fluid received from the first fluid containment structure, a second flow meter coupled to the return port of the blackflow preventer configured to transmit a second signal corresponding to a volume of waste fluid provided to the second fluid containment structure, and a third flow meter coupled to the first fluid containment structure configured to transmit a third signal corresponding to a volume of drilling fluid received at the first fluid containment structure.

2. The system of claim 1, wherein the first fluid containment structure comprises a port disposed in the flexible body and coupled to the first fluid transport structure, the port configured to release fluid out of the fluid containment structure.

3. The system of claim 1, wherein the second fluid containment structure comprises a port disposed in the flexible body and coupled to the second fluid transport structure, the port configured to receive fluid for storage in the fluid containment structure.

4. The system of claim 1, wherein each fluid containment structure comprises a first port and second port, each port disposed in the flexible body and comprising a valve configured to receive fluid and prevent release of the fluid from the tube, and wherein at least one port comprises a locking mechanism configured to engage the valve and release the fluid from the tube.

5. The system of claim 1, wherein the second fluid containment structure is coupled to purification equipment configured to extract recycled drilling fluid from waste fluid, the first fluid containment structure coupled to the purification equipment to receive the recycled drilling fluid.

6. The system of claim 1, wherein the monitoring system is further configured to determine a volume of drilling fluid available in the first fluid containment structure.

7. The system of claim 1, wherein the flow control mechanism comprises:

a forward backflow preventer that activates to substantially prevent waste fluid from entering the forward port, and a flow arrest that activates to substantially prevent transfer of drilling fluid received at the forward port to the return port.

8. The system of claim 1, wherein the flow control mechanism comprises:

a return backflow preventer that activates to substantially prevent waste fluid received from the well to flow back through the return port to the primary port.

9. The system of claim 1, wherein each fluid containment structure is approximately 100' long with a diameter of approximately 36'.

10. The system of claim 9, wherein the second fluid containment structure is contained within a plurality of interlocked fluid containment structures.

11. The system of claim 1, wherein the monitoring system is further configured to compare the measured volumes fluids to perform one or more of automatic scheduling of tanker trucks for drilling fluid replenishment and determine when additional containment structures are needed for fluid storage.

12. A method of fluid containment for use in hydraulic fracturing (fracking), the method comprising:

receiving drilling fluid at a first flexible containment tube for use in a fracking process;

transmitting a first signal corresponding to a measured volume of the drilling fluid received at the first flexible containment tube;

receiving a portion of the drilling fluid at a forward port of a backflow preventer coupled to the first flexible containment tube, the backflow preventer providing the received portion of the drilling fluid to a well coupled to a primary port of the backflow preventer;

transmitting a second signal corresponding to a measured volume of the portion of the drilling fluid received from the first flexible containment tube at the forward port of the backflow preventer;

receiving waste fluid from the well at the primary port of the backflow preventer, the backflow preventer providing the received waste fluid to a second flexible containment tube coupled to a return port of the backflow preventer;

transmitting a third signal corresponding to a measured volume of the waste fluid provided to the second flexible containment tube coupled to the return port of the backflow preventer;

alternately coupling the forward port and the return port with the primary port to provide drilling fluid to the well and receive waste fluid from the well, the backflow preventer substantially preventing flow of waste fluid through the forward port and substantially preventing flow of drilling fluid through the return port;

providing the waste fluid to purification equipment coupled to the second flexible containment tube, the purification equipment generating recycled drilling fluid; and receiving the recycled drilling fluid at the forward port of the backflow preventer.

13. The method of claim 12, further comprising determining an amount of drilling fluid to receive at the first flexible containment tube from an external source based on one or more measurements corresponding to a volume of recycled drilling fluid generated, the measured volume of the portion of the drilling fluid provided to the well, and a capacity of the first flexible containment tube.

14. The method of claim 12, wherein each flexible containment tube is approximately 100' long with a diameter of approximately 36'.

15. The method of claim 12, wherein the backflow preventer comprises a flow control mechanism that substantially prevents the flow of waste fluid through the forward port and substantially prevents the flow of drilling fluid through the return port.

16. The method of claim 15, wherein the flow control mechanism comprises:

a forward backflow preventer that activates to substantially prevent waste fluid from entering the forward port, and a flow arrest that activates to substantially prevent transfer of drilling fluid received at the forward port to the return port.

17. The method of claim 15, wherein the flow control mechanism comprises:

a return backflow preventer that activates to substantially prevent waste fluid received from the well to flow back through the return port to the primary port.

18. The method of claim 12, wherein a plurality of linked flexible containment tubes are coupled to the first flexible containment tube to store the recycled drilling fluid, the plurality of linked flexible containment tubes coupled to the purification equipment to receive the recycled drilling fluid.

19. The method of claim 12, wherein a plurality of linked flexible containment tubes are coupled to the second flexible containment tube to store the waste fluid received from the well.

20. The method of claim 12, further comprising comparing the measured volumes fluids to perform one or more of automatic scheduling of tanker trucks for drilling fluid replenishment and determine when additional flexible containment tubes are needed for fluid storage.

21. The method of claim 12, wherein each flexible containment tube comprises a first port and second port, each port disposed in the flexible body and comprising a valve configured to receive fluid and prevent release of the fluid from the tube, and wherein at least one port comprises a locking mechanism configured to engage the valve and release the fluid from the tube.

* * * * *